US006076600A

United States Patent [19]

Vick, Jr. et al.

[11] Patent Number: 6,076,600

[45] Date of Patent: Jun. 20, 2000

[54] PLUG APPARATUS HAVING A DISPERSIBLE PLUG MEMBER AND A FLUID BARRIER

[75] Inventors: James D. Vick, Jr., Dallas; David L. Reesing, Irving, both of Tex.; Ewan O. Robb, Angus, United Kingdom

[73] Assignee: Halliburton Energy Services, Inc., Dallas, Tex.

[21] Appl. No.: 09/031,632

[22] Filed: Feb. 27, 1998

[51] Int. Cl.[7] ..... E21B 33/12

[52] U.S. Cl. ..... 166/192; 166/376

[58] Field of Search ..... 166/376, 135, 166/192, 169, 162

[56] References Cited

U.S. PATENT DOCUMENTS

| | | | |
|---|---|---|---|
| 3,362,476 | 1/1968 | Van Poollen . | |
| 3,861,467 | 1/1975 | Harnsberger | 166/276 |
| 4,154,303 | 5/1979 | Fournier | 166/317 |
| 4,160,484 | 7/1979 | Watkins | 166/317 |
| 4,186,803 | 2/1980 | Mondshine | 166/292 |
| 4,216,830 | 8/1980 | Fredd | 166/319 |
| 4,374,543 | 2/1983 | Richardson | 166/192 |
| 4,378,049 | 3/1983 | Hsu et al. | 166/295 |
| 4,423,773 | 1/1984 | Stout | 166/317 |
| 4,428,427 | 1/1984 | Friedman | 166/278 |
| 4,433,702 | 2/1984 | Baker | 137/527.6 |
| 4,541,484 | 9/1985 | Salerni et al. | 166/278 |
| 4,597,445 | 7/1986 | Knox | 166/319 |
| 4,691,775 | 9/1987 | Lustig et al. | 166/317 |
| 4,721,159 | 1/1988 | Ohkochi et al. | 166/286 |
| 4,813,481 | 3/1989 | Sproul et al. | 166/51 |
| 4,817,720 | 4/1989 | Friedman et al. | 166/295 |
| 4,888,240 | 12/1989 | Graham et al. | 428/403 |
| 4,898,750 | 2/1990 | Friedman et al. | 427/221 |
| 5,181,569 | 1/1993 | McCoy et al. | 166/317 |
| 5,188,182 | 2/1993 | Echols, III et al. | 166/376 |
| 5,188,183 | 2/1993 | Hopmann et al. | 166/387 |
| 5,253,706 | 10/1993 | Reid | 166/135 |
| 5,404,956 | 4/1995 | Bohlen et al. | 166/387 |
| 5,417,285 | 5/1995 | Van Buskirk et al. | 166/292 |
| 5,441,111 | 8/1995 | Whiteford | 166/387 |
| 5,479,986 | 1/1996 | Gano et al. | 166/292 |
| 5,607,017 | 3/1997 | Owens et al. | 166/288 |
| 5,685,372 | 11/1997 | Gano | 166/292 |
| 5,765,641 | 6/1998 | Shy et al. | 166/292 |

OTHER PUBLICATIONS

Omega 2.1 Unibalance Pressure Cycle Plug; information sheets; 6 pages; 1995.

*Primary Examiner*—George Suchfield

*Attorney, Agent, or Firm*—William M. Imwalle; Marlin R. Smith

[57] ABSTRACT

A plug apparatus is provided which includes a dispersible plug member and a fluid barrier. In one embodiment described herein, a fluid barrier is utilized to prevent contamination of fluid contained in a plug apparatus. The fluid is thus available for use in dispersing a plug member of the plug apparatus, regardless of the types of other fluids present in a well in which the apparatus is installed. Various configurations of fluid barriers are also provided.

108 Claims, 11 Drawing Sheets

PLUG APPARATUS HAVING A DISPERSIBLE PLUG MEMBER AND A FLUID BARRIER

BACKGROUND OF THE INVENTION

The present invention relates generally to equipment utilized in conjunction with operations performed in subterranean wells and, in an embodiment described herein, more particularly provides a plug apparatus having a fluid barrier.

It is known to construct a plug apparatus using a dispersible plug member, that is, a plug member or a portion thereof that is dissolvable or otherwise dispersible by contact with fluid. For example, the member may be initially isolated from contact with fluid and then, when it is desired to permit flow through the plug apparatus, fluid is placed in communication with the member, thereby dispersing the member. Such dispersible plug members have been constructed using compacted salt and sand mixtures, although other types of members may be utilized as well.

However, it is sometimes the case that the member may not be readily dispersible by contact with whatever fluid happens to be present in the well at the time it is desired to permit flow through the plug apparatus. For example, if the member is dispersible by dissolving a salt constituent thereof in fluid, and the fluid in the well is salt-saturated or oil-based, the salt constituent may not be readily dissolvable in the fluid. This situation may also occur where, for example, the member is dispersible by contact with a particular type of fluid, and that particular type of fluid is not present in the well, or is not otherwise available for contacting the member. For example, if the member is dispersible by a reaction with a particular type of fluid, and the fluid is not present in a tubular string attached to the plug apparatus, it may be difficult or inconvenient to provide that fluid for contact with the member at the time it is desired to permit flow through the plug apparatus.

Therefore, it would be very advantageous to provide a plug apparatus with the capability of dispersing its plug member, no matter the fluid present in the well at the time it is desired to permit flow through the plug apparatus. Additionally, it would be advantageous to provide a plug apparatus with the capability of transporting a fluid therewith which may be used to disperse its plug member. Furthermore, it would be advantageous to provide a fluid barrier which prevents contamination of fluid in a plug apparatus. Accordingly, objects of the present invention include providing such plug apparatus and fluid barriers.

SUMMARY OF THE INVENTION

In carrying out the principles of the present invention, in accordance with an embodiment thereof, a plug apparatus is provided which includes a dispersible plug member and a fluid barrier. The fluid barrier may be utilized in the plug apparatus to prevent contamination of fluid contained in the plug apparatus for dispersing the plug member, or the fluid barrier may be separately utilized and/or used with other apparatus.

In one aspect of the present invention, apparatus is provided which includes a housing having a flow passage formed therethrough, a dispersible plug member preventing flow through the passage, at least one barrier substantially isolating a volume of fluid from contamination, and a dispersing mechanism selectively preventing and permitting fluid communication between the volume of fluid and the plug member. In this manner, the fluid is available for dispersing the plug member when the dispersing mechanism is actuated to permit flow through the flow passage.

In another aspect of the present invention, apparatus is provided which includes a housing having a flow passage formed therethrough, a dispersible plug member preventing flow through the flow passage, and at least one barrier substantially maintaining a volume of fluid between the barrier and the plug member. Thus, the fluid is contained in the plug apparatus between the barrier and the plug member.

In still another aspect of the present invention, a barrier is provided, which may be utilized in conjunction with a plug apparatus, or utilized separately therefrom. The barrier may include a peripheral portion and a body portion. The barrier may be porous or may have portions thereof which are porous and/or have one or more openings formed therethrough. Additionally, multiple barriers may be combined, filtering devices may be combined with one or more of the barriers, etc. A variety of unique configurations of fluid barriers are provided.

These and other features, advantages, benefits and objects of the present invention will become apparent to one of ordinary skill in the art upon careful consideration of the detailed descriptions of representative embodiments of the invention hereinbelow and the accompanying drawings.

DETAILED DESCRIPTION

Figure 1A:
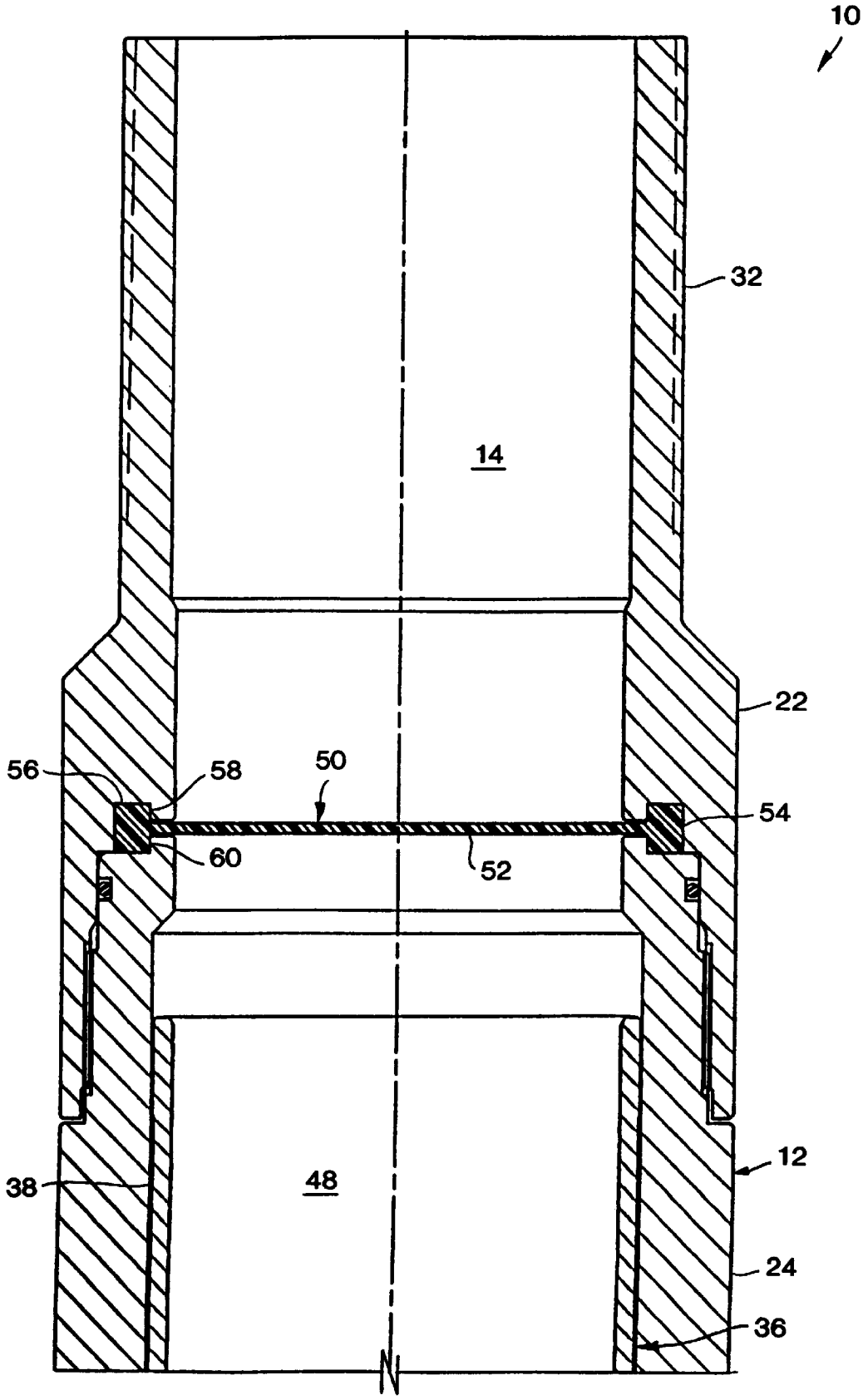
FIGS. 1A–E are cross-sectional views of a first plug apparatus embodying principles of the present invention.
Figure 1B:
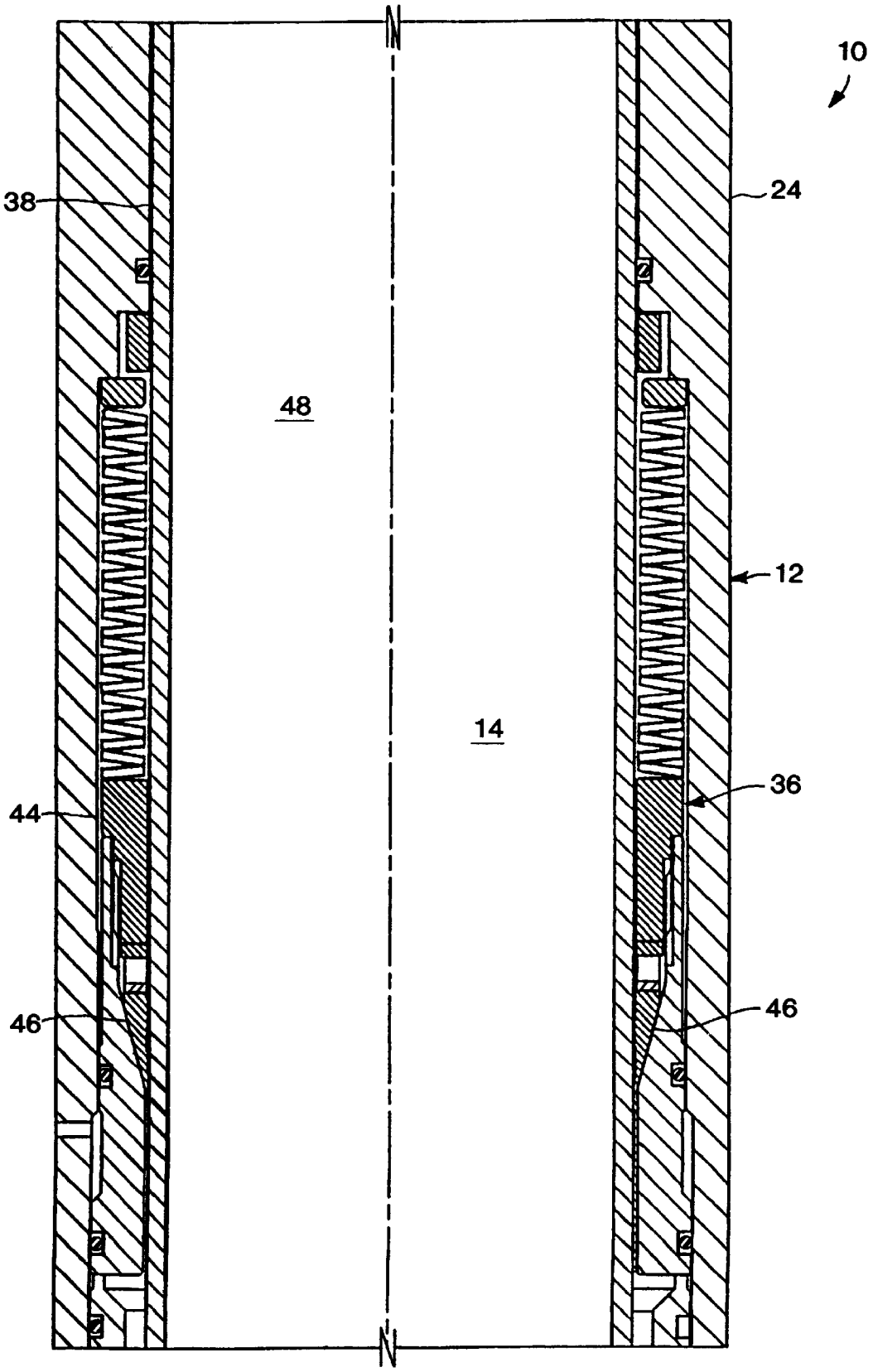

Representatively illustrated in FIGS. 1A–E is a plug apparatus 10 which embodies principles of the present invention. In the following description of the plug apparatus 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

In some respects, the plug apparatus 10 is similar to a Mirage Plug manufactured and marketed by Halliburton Energy Services of Dallas, Tex. Details of the construction and operation of a plug apparatus including a dispersible plug member are set forth in U.S. Pat. No. 5,479,986. However, it is to be clearly understood that principles of the present invention may be incorporated in plug apparatus which are dissimilar in many respects to the Mirage Plug. For example, a plug apparatus incorporating principles of the present invention could be constructed which is similar in some respects to an Anvil Plug manufactured and marketed by Petroleum Engineering Services of Aberdeen, Scotland.

In the embodiment representatively illustrated in FIGS. 1A–E, the plug apparatus 10 includes a generally tubular housing assembly 12 having a flow passage 14 formed axially therethrough. The housing assembly 12 as shown in FIGS. 1A–E is made up of several threadedly and sealingly interconnected portions 22, 24, 26, 28, 30. However, it is to be understood that greater or fewer numbers of housing portions may be utilized in the housing assembly 12, and the portions may be otherwise configured, otherwise attached to each other, etc., without departing from the principles of the present invention. Upper and lower housing portions 22, 30 are provided with threads 32, 34, respectively, for interconnection of the plug apparatus 10 in a tubular string, in a manner well known to those skilled in the art.

Fluid flow through the passage 14 is initially blocked by a dispersible plug member 16. The plug member 16 includes a dispersible portion 18, which h initially outwardly supports generally impervious end closures 20 sealingly received in the flow passage 14 and isolating the dispersible portion 18 from contact with any fluid in the flow passage.

In the plug apparatus 10, the dispersible portion 18 is a compacted salt and sand composition which has sufficient compressive strength to resist fluid pressure in the flow passage 14. However, when a fluid is permitted to contact the dispersible portion 18, the salt constituent may dissolve in the fluid. This dissolving of the salt constituent significantly reduces the dispersible portion's 18 compressive strength, so that it is no longer able to resist fluid pressure in the flow passage. The end closures 20, thus, become substantially unsupported and may be conveniently ruptured by the fluid pressure in the flow passage 14, or by passage of an item of equipment through the flow passage.

Therefore, the plug member 16 is dispersed by dissolving the portion 18 (or a constituent part thereof) using fluid in the flow passage. However, if fluid is not available which is capable of dispersing the plug member 16, for example, if the fluid in the flow passage 14 is salt-saturated, oil-based, or otherwise incapable of dissolving a constituent part of the portion 18, it may be difficult, inconvenient and/or impractical to open the flow passage to flow therethrough. A similar type of problem may occur when a plug member is utilized that is dispersed by a method other than dissolving a constituent part of a portion of the plug member. For example, if the plug member is dispersed by a reaction of a portion thereof with a fluid, and the type of fluid needed to react with the portion is not available to be placed in contact with the portion, this situation may make it difficult, inconvenient and/or impractical to open the flow passage in which the plug member is disposed to flow therethrough.

In the representatively illustrated plug apparatus 10, a dispersing mechanism 36 is used to selectively provide fluid communication between the flow passage 14 and the dispersing portion 18. The mechanism 36 includes a sleeve 38, which is initially sealingly received in the flow passage 14, thereby preventing fluid flow through a series of ports 40 formed through a downwardly extending portion of the housing portion 26. The ports 40 are in fluid communication with an annular space 42 formed radially between the housing portions 26, 28, and the annular space is, in turn, in fluid communication with the dispersing portion 18.

Figure 1C:
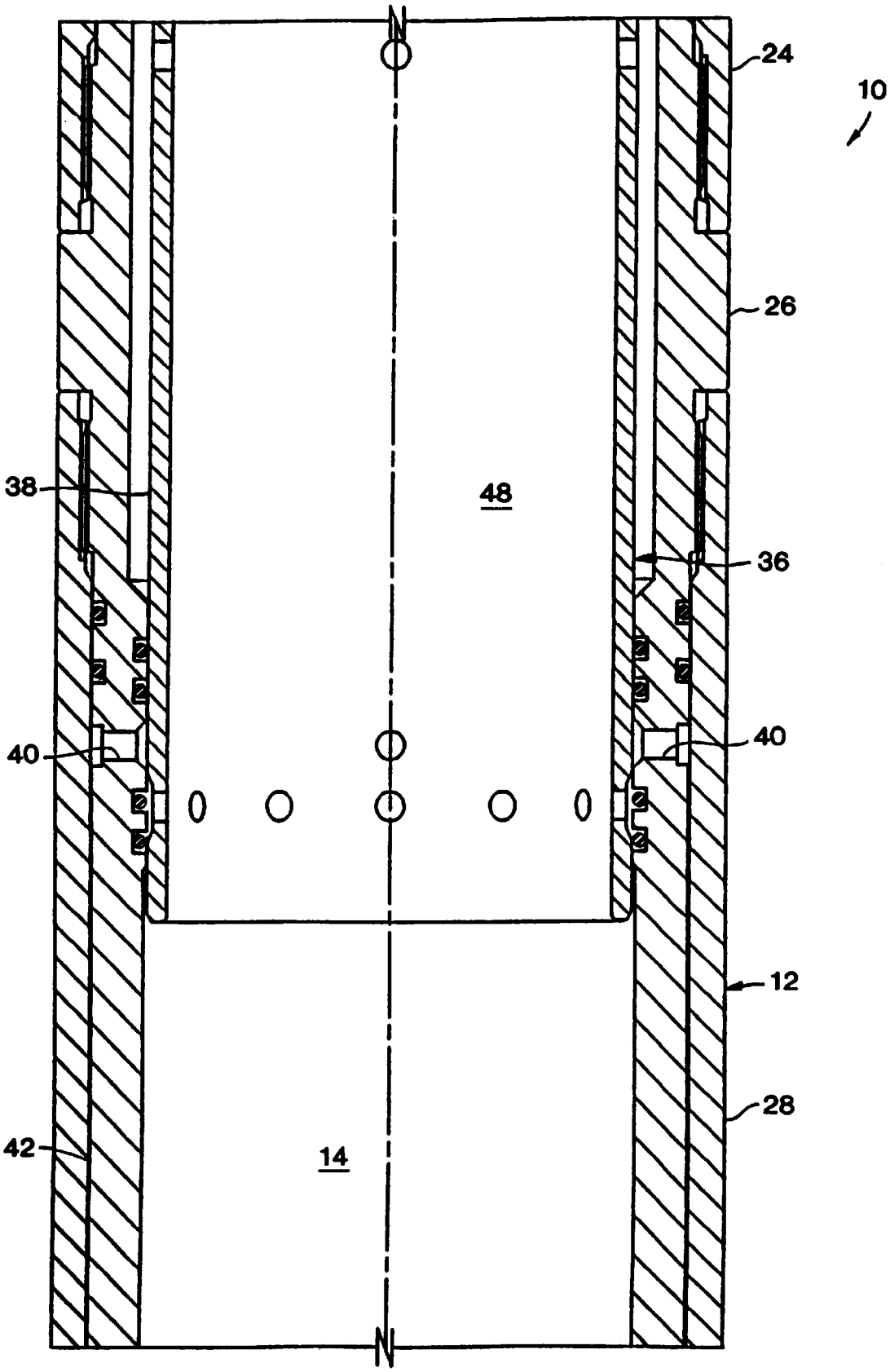
Figure 1D:
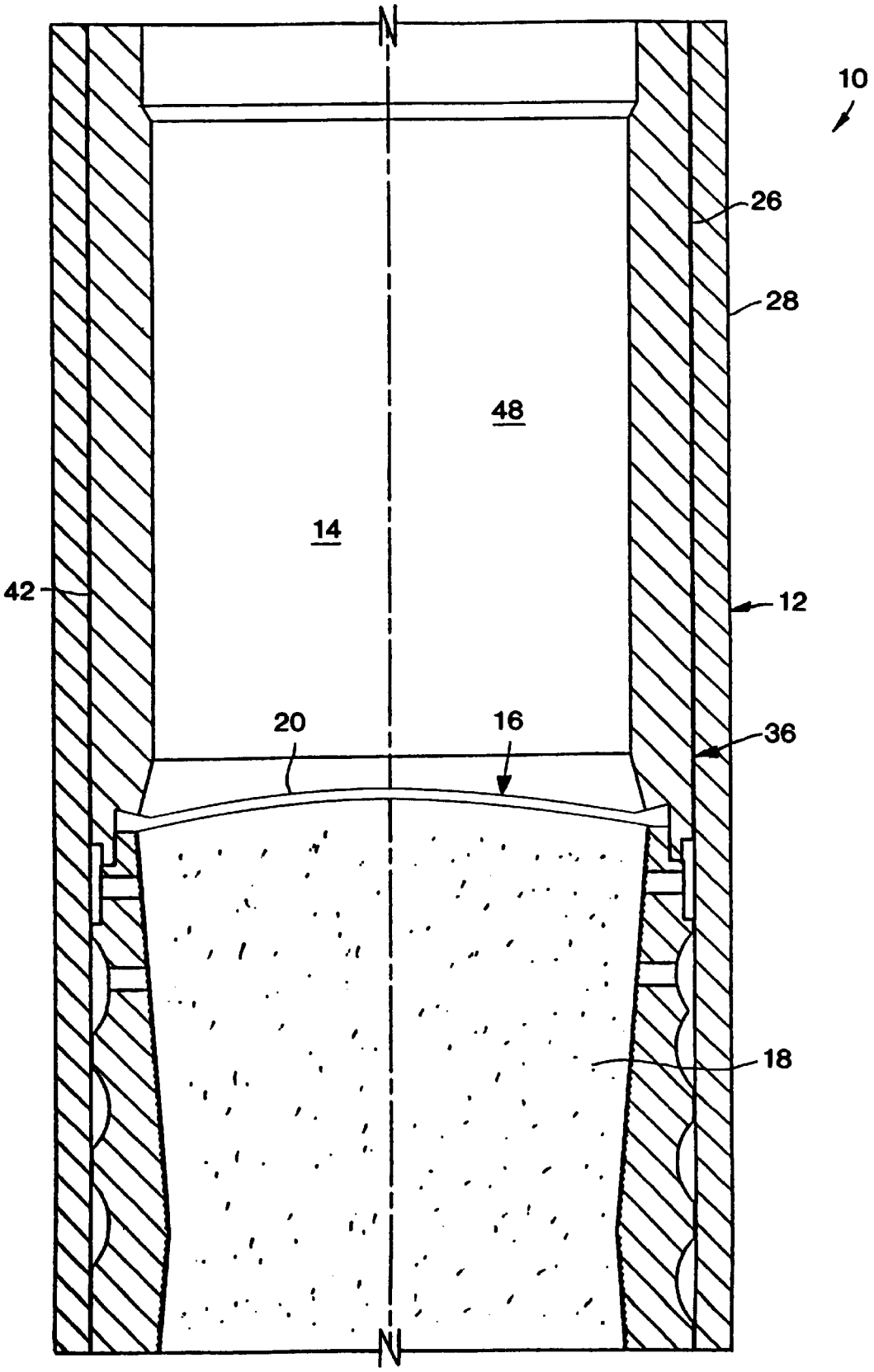
Figure 1E:
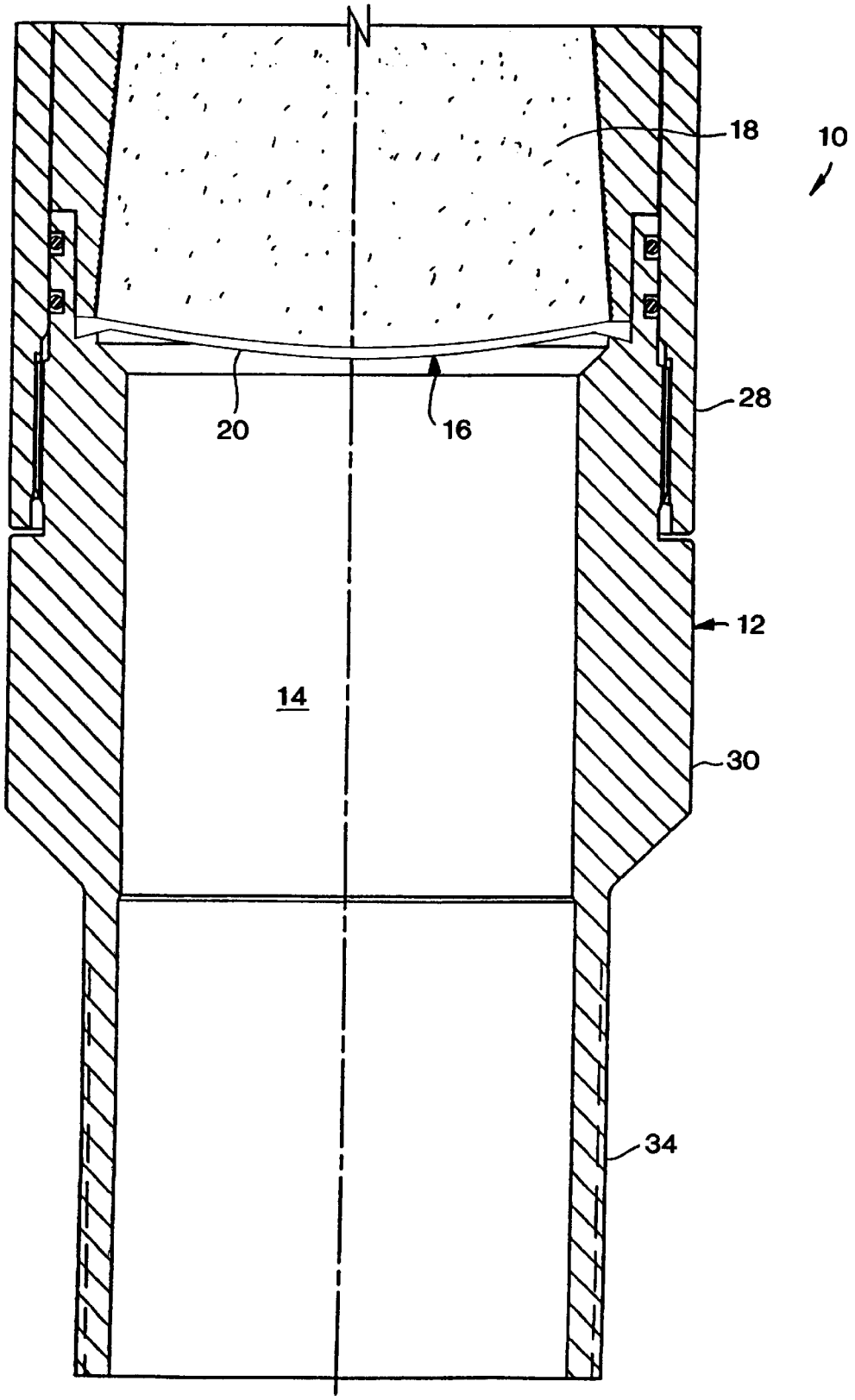
Figure 2A:
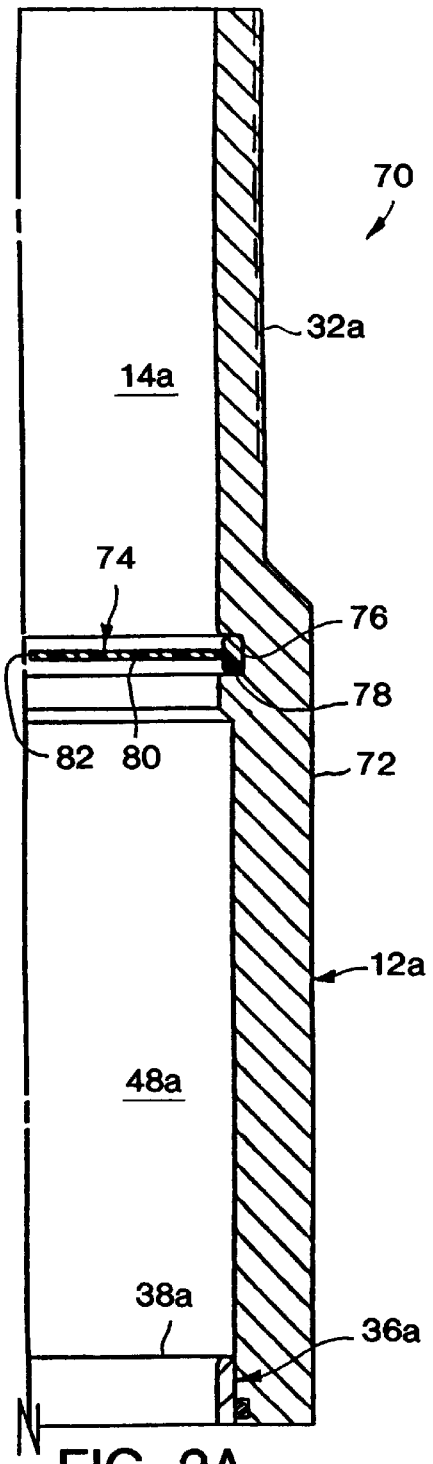
FIGS. 2A–D are quarter-sectional views of a second plug apparatus embodying principles of the present invention.
Figure 2B:
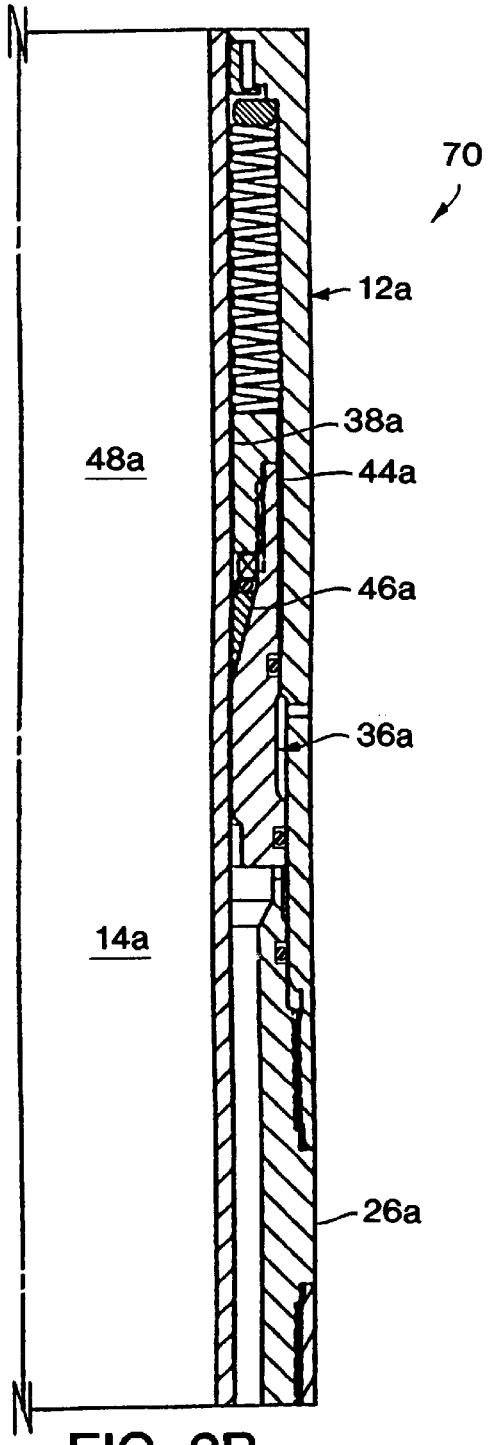
Figure 2C:
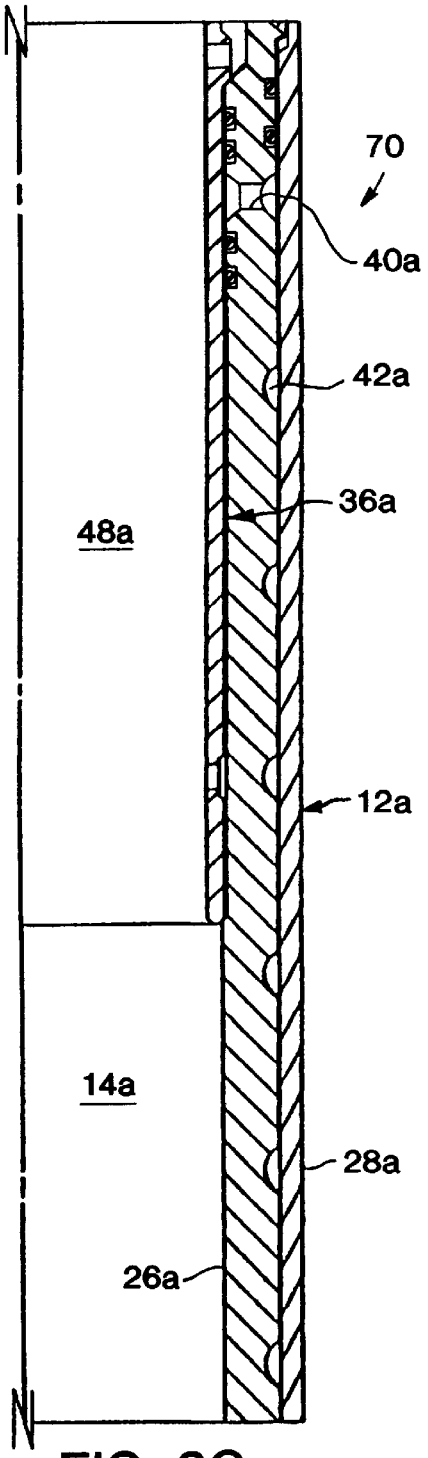
Figure 2D:
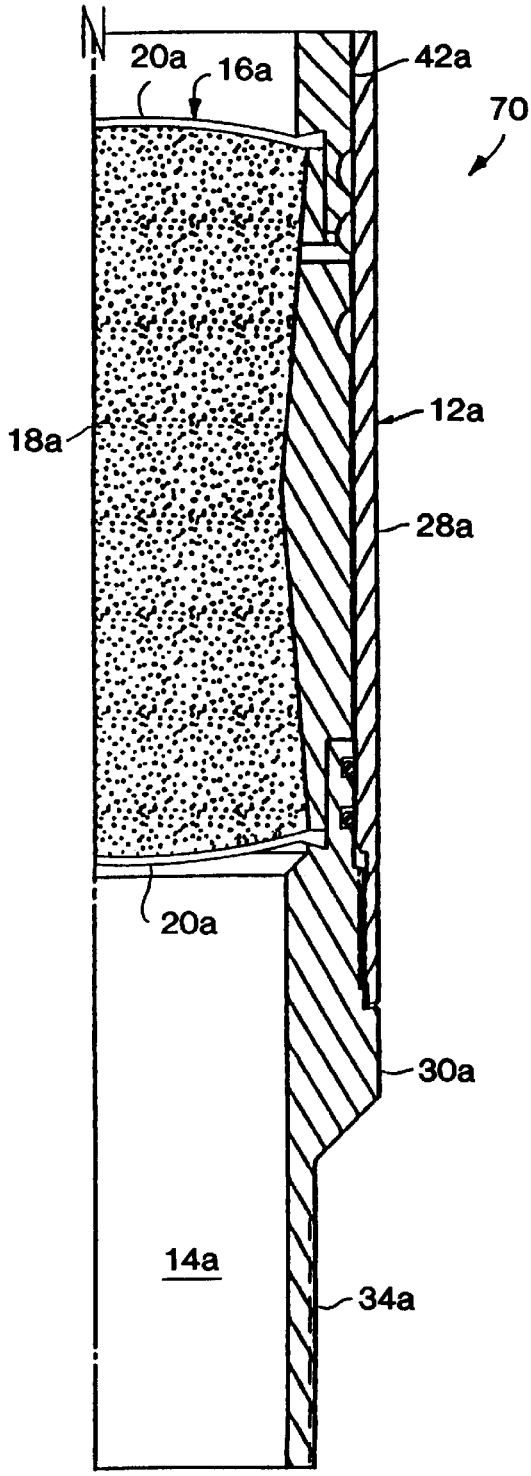

As shown in FIGS. 1A–E, the sleeve 38 has been upwardly displaced relative to the housing assembly 12, so that the ports 40 are now in fluid communication with an upper portion of the flow passage 14 above the plug member 16. The plug member 16 will now be dispersed by contact between the fluid and the portion 18. Such upward displacement of the sleeve 38 is accomplished by a predetermined number of fluid pressure applications to the flow passage 14, for example, by applying the fluid pressures to the tubular string at the earth's surface. The fluid pressure applications cause an axial ratcheting mechanism 44, which includes internal slips 46, to successively grip and incrementally upwardly displace the sleeve 38. When a sufficient number of the fluid pressure applications have been performed, the sleeve 38 no longer blocks fluid flow through the ports 40, but permits flow therethrough as shown in FIG. 1C.

It is to be clearly understood that a plug apparatus incorporating principles of the present invention could be constructed having a dispersing mechanism different from that shown in FIGS. 1A–E. For example, the dispersing mechanism could include a rotational ratcheting mechanism, such as a J-slot type ratchet, instead of the axial ratcheting mechanism. The sleeve 38 or another member could be rotationally displaced, instead of axially displaced, to provide fluid communication between the flow passage 14 and the portion 18. Fluid communication could be provided between the exterior, instead of the interior, of the housing assembly 12 and the portion 18. Fluid communication could be provided between the flow passage 14 below, instead of above, the plug member 16 and the portion 18. Fluid communication could be provided between the portion 18 and a separate fluid chamber, instead of the flow passage 14. Fluid communication could be provided by methods other than application of fluid pressure. These and many other changes could be made without departing from the principles of the present invention.

In order to ensure that a fluid 48 that will initiate dispersal of the plug member 16 is available at the time it is desired to permit flow through the passage 14, a volume of the fluid is maintained in the flow passage and protected from contamination with other fluids and debris in the well during conveyance of the plug apparatus 10 into the well and thereafter. For this purpose, a fluid barrier 50 extends laterally across the flow passage 14, thus isolating the fluid 48 from contact with any other fluid or debris in the flow passage 14 above the barrier. Therefore, the fluid 48 is maintained between the barrier 50 and the upper end closure 20 of the plug member 16, and is available for flow into the ports 40 and contact with the portion 18 when the dispersing mechanism 36 is actuated to provide fluid communication between the flow passage 14 and the portion 18.

As representatively illustrated in FIG. 1A, the barrier 50 includes a body portion 52 extending across the flow passage 14 and a somewhat enlarged annular-shaped peripheral portion 54 retained between the housing portions 22, 24. It is to be clearly understood, however, that it is not necessary for the barrier 50 to include separately identifiable body and peripheral portions, for the barrier to extend across the flow passage 14 and maintain the fluid 48 between the barrier and the plug member 16, for the peripheral portion to be enlarged relative to the body portion, or for the barrier or the peripheral portion thereof to be retained between the housing portions 22, 24. Additionally, the body and peripheral portions 52, 54 could be separately formed and later bonded or otherwise attached to each other. Such attachment could occur upon installation of the barrier 50 in the plug apparatus 10.

Note that, by retaining the barrier 50 between the threadedly attached housing portions 22, 24 at the upper end of the plug apparatus 10, it is convenient to fill the fluid 48 into the flow passage 14 above the plug member 16, then place the barrier 50 on top of the housing portion 24, and then attach the housing portion 22 to the housing portion 24, prior to interconnecting the plug apparatus in the tubular string. However, it is to be understood that other methods of introducing the fluid 48 into the flow passage 14 between the barrier 50 and the plug member 16 may be utilized, without departing from the principles of the present invention. Some alternative methods are described below.

When the barrier 50 is installed between the housing portions 22, 24, the peripheral portion 54 is received in a recess 56 formed in the housing portion 22, and the peripheral portion is radially outwardly retained by shoulders 58, 60 formed on the housing portions 22, 24, respectively. Of course, other methods of retaining the barrier 50 may be used in a plug apparatus incorporating principles of the present invention, and some of these alternate methods are described below.

When the housing portion 22 is attached to the housing portion 24, the barrier peripheral portion 54 is sealingly received therebetween. Such sealing engagement of the barrier 50 acts to completely isolate the fluid 48 from other fluids in the well. However, it is to be clearly understood that it is not necessary for the fluid 48 to be completely isolated from other fluids in the well for proper functioning of the plug apparatus 10. For example, limited communication between the fluid 48 and other fluids in the well may be permitted without the fluid 48 becoming so contaminated that the fluid 48 will not initiate dispersal of the plug member 16 upon contact with the portion 18. Therefore, the barrier 50 may permit some communication between the fluid 48 and other fluids in the well, while still preventing undesirable contamination of the fluid 48.

The barrier 50, or any portion thereof, may be made of an elastomeric material, or it may be made of a nonelastomeric material. An elastomeric material is preferred at least for the body portion 52 in the embodiment shown in FIGS. 1A–E, since applications of fluid pressure are made to the flow passage 14 as described above to actuate the dispersing mechanism. The body portion 52 being made of an elastomeric material, it is able to flex and elongate in response to these pressure applications. However, the barrier 50, or any portion thereof, could also be made of other rigid or flexible materials, such as plastics, metals, etc., and pressure fluctuations, expansion and contraction of the fluid 48, etc., may be accommodated by other methods, without departing from the principles of the present invention.

Referring additionally now to FIGS. 2A–D, another plug apparatus 70 embodying principles of the present invention is representatively illustrated. The plug apparatus 70 is similar in many respects to the previously described plug apparatus 10. Elements which are similar to those previously described are indicated in FIGS. 2A–D using the same reference numbers, with an added suffix "a".

In FIGS. 2A–D, the plug apparatus 70 is representatively illustrated prior to the fluid pressure applications described above. Thus, the sleeve 38*a* of the dispersing mechanism 36*a* is still sealingly engaged across the ports 40*a*, thereby preventing fluid communication between the flow passage 14*a* and the ports. However, it will be readily appreciated that the sleeve 36*a* may be upwardly displaced relative to the housing assembly 12*a* in response to fluid pressure applications, in a manner similar to that described above, to place the ports 40*a* in fluid communication with the flow passage 14*a*, in order to initiate dispersal of the plug member 16*a*.

The housing assembly 12*a* differs somewhat from the housing assembly 12 of the plug apparatus 10. The housing assembly 12*a* includes fewer portions, specifically, in place of the two housing portions 22, 24, the housing assembly 12*a* has a housing portion 72. Thus, a fluid barrier 74 of the plug apparatus 70 is not retained between separate housing portions as in the plug apparatus 10.

Instead, the barrier 74 is retained in an annular recess 76 formed in the upper housing portion 72. To install the barrier 74, it is folded, or otherwise radially reduced, inserted into the flow passage 14*a* in the housing portion 72, and then permitted to radially expand into the recess 76. An outer annular-shaped peripheral portion 78 of the barrier 74 is received in the recess 76, and a body portion 80 of the barrier extends laterally across the flow passage 14*a*. As with the barrier 50 described above, the barrier 74 is formed of an elastomeric material, although other materials may be used for the barrier 74, and it is to be clearly understood that the barrier 74 may be otherwise-shaped, made of rigid or flexible materials, or a combination thereof, differently positioned, differently configured, differently oriented, etc., without departing from the principles of the present invention.

The barrier 74 differs in at least one significant respect from the barrier 50 in that it has a small opening 82 formed therethrough. The opening 82 permits limited fluid communication across the barrier 74, without allowing sufficient communication to significantly contaminate the fluid 48*a*. Thus, the fluid 48*a* will still initiate dispersal of the plug member 16*a* upon contact with the fluid 48*a*, the fluid remaining sufficiently uncontaminated even though some communication is permitted across the barrier 74. Note that more than one opening 82 may be provided in the barrier 74, and these openings may be arrayed in any pattern or randomly.

The opening 82 permits expansion and contraction of the volume of the fluid 48*a* and/or pressure applications to the flow passage 14*a*, without requiring the barrier 74*a* to elongate or flex. The opening 82 also permits the fluid 48*a* to be introduced into the flow passage 14*a* above the plug member 16a by pouring the fluid into the flow passage above the barrier and letting it flow downward through the opening, or by otherwise forcing the fluid through the barrier. Alternatively, the barrier 74 could be installed after the fluid 48*a* is introduced into the flow passage 14*a* above the plug member 16*a*.

Referring additionally now to FIGS. 3–10, alternate configurations of barriers are representatively and schematically illustrated, each embodying principles of the present invention. For convenience of illustration and description, each barrier is illustrated installed in a tubular member or structure, apart from the remainder of any apparatus of which the tubular member is a portion. It is to be understood that each of the tubular members may be a portion of one of the housing assemblies 12, 12*a* described above, or it may be a portion of another apparatus.

Figure 3:
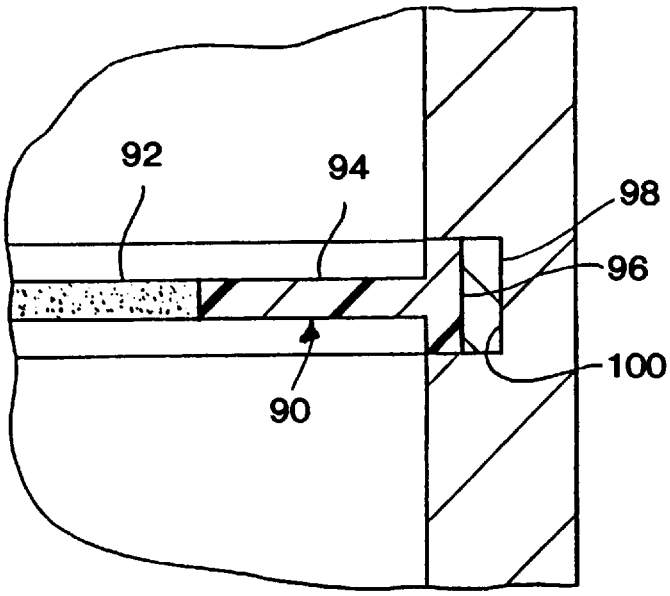
FIGS. 3–10 are partial cross-sectional views of fluid barriers, each of which embody principles of the present invention.

In FIG. 3, a barrier 90 is shown which includes a porous portion 92, which permits limited fluid communication across the barrier. The porous portion 92 may be a filtering device, such as a sintered metal, wire screen, etc., which prevents debris from passing through the barrier 90. The porous portion 92 is a part of a body portion 94 of the barrier 90. A somewhat enlarged annular-shaped peripheral portion 96 of the barrier 90 is attached to a stiffener 98. The stiffener 98 may be made of a metallic or nonmetallic material, and may be attached to the peripheral portion 96 by adhesive bonding, thermal bonding, or by any other method. The stiffener 98 acts to resist dislocation of the barrier 90 from a recess 100 in which the barrier is installed.

Figure 4:
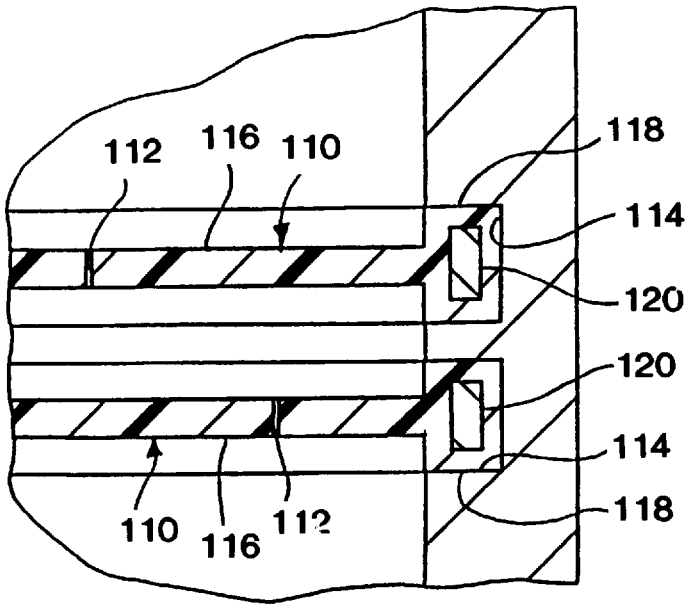

In FIG. 4, multiple barriers 110 are utilized to prevent contamination of fluid. Openings 112 formed through a body portion 116 of each of the barriers 110 are offset or misaligned with respect to each other, in order to provide a tortuous path for fluid flowing through the barriers, thereby further impeding contamination of the fluid protected by the barriers. The barriers 110 are axially spaced apart and a peripheral portion 118 of each is received in an annular recess 114. A stiffener 120, similar to the stiffener 98 described above, is molded within each of the peripheral portions 118.

Figure 5:
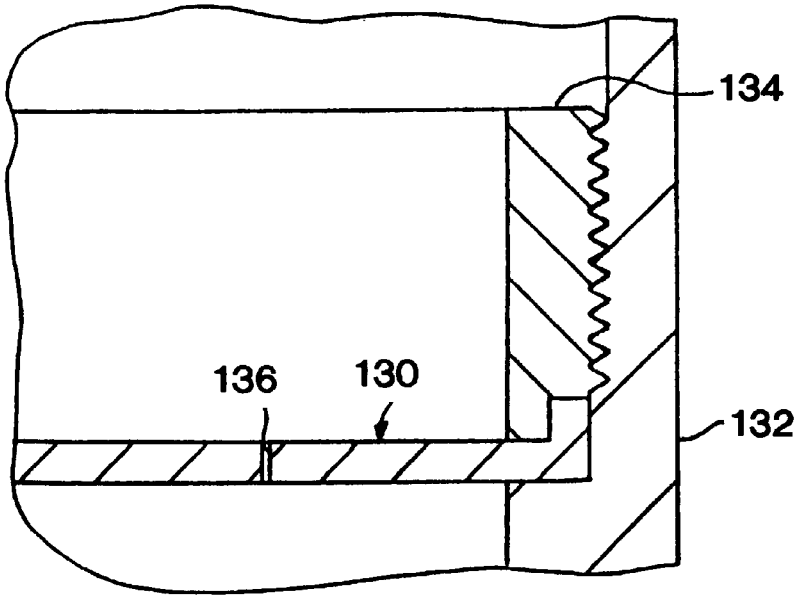

In FIG. 5, a substantially rigid or inflexible barrier 130 is shown installed in a tubular member 132 and retained therein by a ring 134 threadedly secured in the tubular member. An opening 136 is provided through the barrier 130. The barrier 130 is representatively illustrated as being made of a metallic material, but other materials, such as elastomers, plastics, ceramics, etc., may be used without departing from the principles of the present invention.

Figure 6:
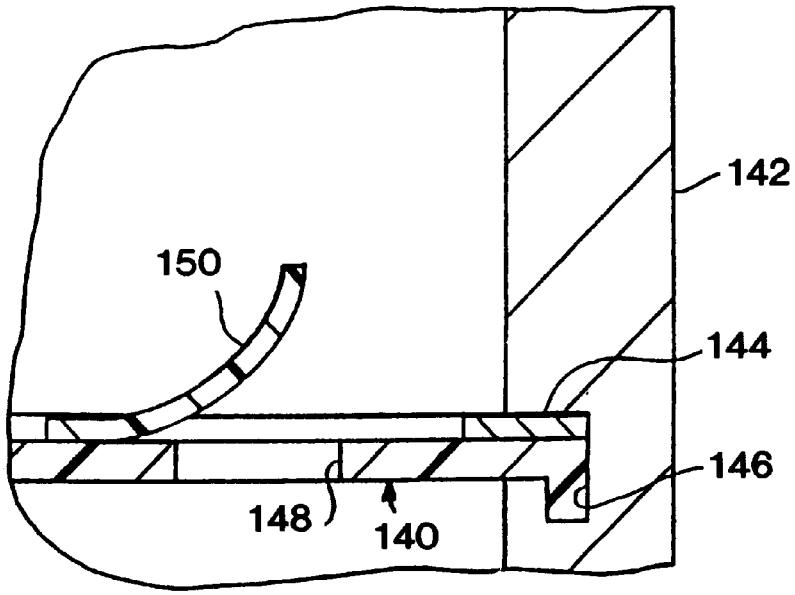

In FIG. 6, a barrier 140 is shown installed in a tubular member 142. The barrier 140 is retained therein by a snap ring, circlip, or other circular fastener 144 engaged in an annular recess 146 formed in the tubular member 142. The barrier 140 is provided with an opening 148 formed therethrough. An optional flap or closure member 150 is provided for selectively blocking the opening 148. The closure 150 is shown in FIG. 6 as it would be positioned to allow introduction of fluid into the tubular member 142 below the barrier 140, thus permitting convenient filling of the tubular member 142 with the fluid. Note that, when the closure 150 is permitted to close against the remainder of the barrier 140, thereby blocking the opening 148, the combined closure and opening may serve as a check valve to accommodate expansion of the volume of the fluid below the barrier. Of course, other types of check valves may be used with the barrier 140 without departing from the principles of the present invention.

Figure 7:
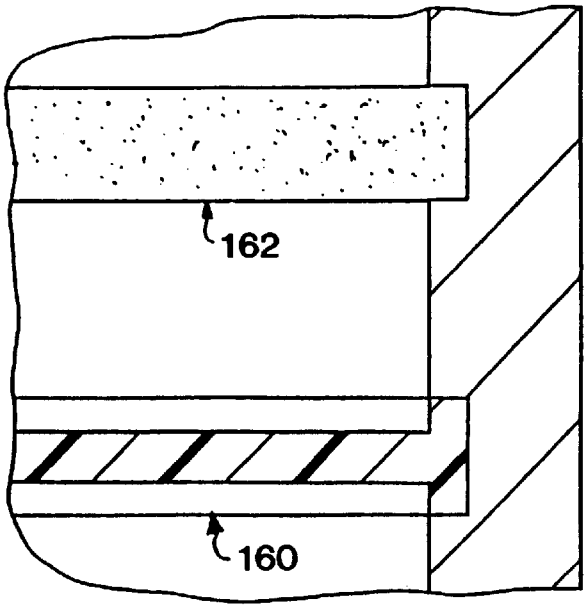

In FIG. 7, a combination of spaced apart barriers 160, 162 is shown. The barrier 160 may be similar to the barrier 50 described above, or may be another type of barrier. The barrier 162 is shown as a porous generally disc-shaped barrier. The barrier 160 provides fluid isolation thereacross, while the barrier 162 prevents debris from passing therethrough. This configuration indicates that barriers may be advantageously combined, and that one barrier may serve as a backup to another barrier. For example, if the barrier 160 were to fail, such as due to excessive fluid pressure applied thereto, the barrier 162 would still limit fluid communication therethrough and prevent debris contamination of fluid therebelow.

Figure 8:
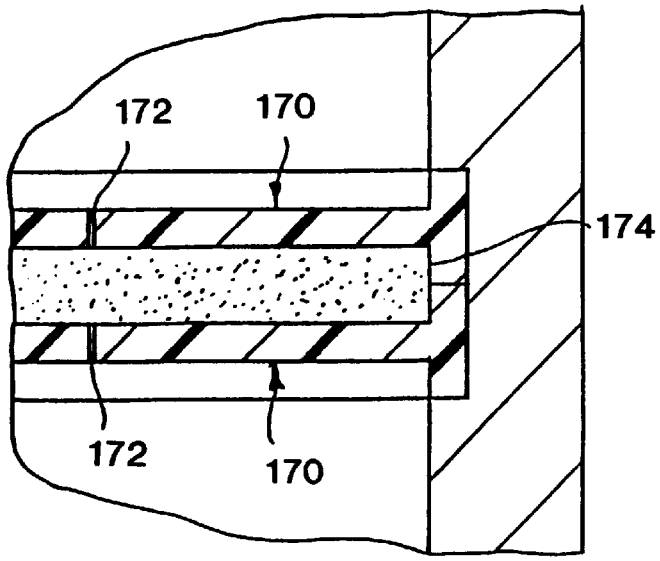

In FIG. 8, another combination of barriers is shown. Two barriers 170 are utilized, each having at least one opening 172 formed therethrough. A porous barrier or filtering device 174 is positioned between the barriers 170. The openings 172 may be offset or misaligned as shown for the barriers 110 in FIG. 4, in order to force fluid passing therethrough to take a tortuous path through the filtering device 174.

Figure 9:
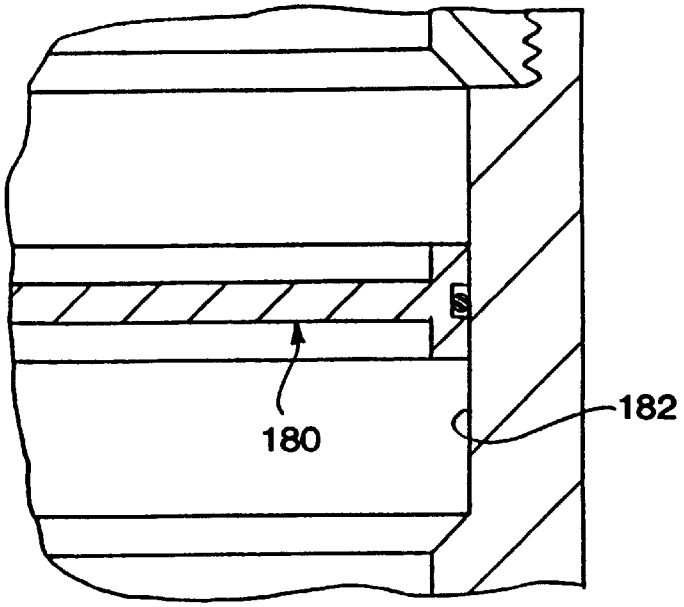

In FIG. 9, a barrier 180 is shown axially reciprocably and sealingly received in a seal bore 182. By permitting such axial movement of the barrier 180, pressure fluctuation and/or expansion and contraction of the fluid therebelow may be accommodated. The barrier 180 may be made of a metallic or substantially rigid material as indicated in FIG. 9, or it may be made of a nonmetallic or substantially flexible material.

Figure 10:
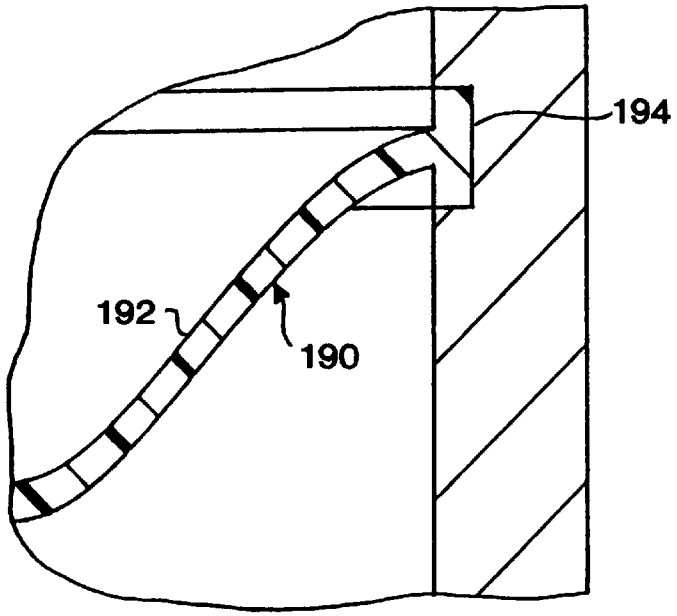

In FIG. 10, a barrier 190 is shown which has a body portion 192 that is substantially axially displaceable relative to a peripheral portion 194 of the barrier. In this manner, the body portion 192 is axially displaceable without requiring it to elongate. Thus, the body portion 192 may be made of an elastomeric or nonelastomeric material, with the body portion displacing to accommodate expansion and contraction of the fluid, pressure applications, etc., without the need for the body portion to elongate, or at least reducing the elongation required of the body portion.

Of course, many modifications, additions, deletions, substitutions, and other changes may be made to the plug apparatus and barriers described above, which changes would be obvious to one skilled in the art, and such changes are contemplated by the principles of the present invention. For example, certain of the barriers described above could be made of a material, such as natural rubber, which progressively degrades over time, so that the barrier would essentially permit unimpeded flow therethrough after a period of time. Accordingly, the foregoing detailed description is to be clearly understood as being given by way of illustration and example only, the spirit and scope of the present invention being limited solely by the appended claims.

What is claimed is:

1. Apparatus operatively positionable in a subterranean well, the apparatus comprising:

a housing having a flow passage formed therethrough;

a dispersible plug member preventing flow through the flow passage, dispersal of the plug member being initiated upon contact with a fluid;

at least one barrier spaced apart from the plug member and substantially isolating a volume of the fluid from contamination, the isolated volume of the fluid being disposed between the barrier and the dispersible plug member; and a dispersing mechanism selectively preventing and permitting fluid communication between the volume of the fluid and the plug member.

2. The apparatus according to claim 1, wherein the barrier is made of an expandable material, the barrier cooperatively expanding and contracting in response to expansion and contraction of the volume of the fluid.

3. The apparatus according to claim 1, wherein the barrier is porous.

4. The apparatus according to claim 1, wherein the barrier includes at least one opening formed therethrough.

5. The apparatus according to claim 1, wherein the apparatus includes at least two barriers.

6. The apparatus according to claim 5, wherein only one of the barriers has at least one opening formed therethrough.

7. The apparatus according to claim 5, wherein each of the barriers has at least one opening formed therethrough.

8. The apparatus according to claim 7, wherein the openings formed through adjacent ones of the barriers are aligned.

9. The apparatus according to claim 7, wherein the openings formed through adjacent ones of the barriers are misaligned.

10. The apparatus according to claim 5, further comprising a filtering device disposed between the barriers.

11. The apparatus according to claim 5, wherein less than all of the barriers have an opening formed therethrough.

12. The apparatus according to claim 1, wherein only a portion of the barrier is made of a porous material.

13. The apparatus according to claim 1, wherein the barrier is axially spaced apart from the plug member.

14. The apparatus according to claim 1, wherein the barrier is retained within the housing.

15. The apparatus according to claim 1, wherein a peripheral edge of the barrier is retained within an annular recess formed within the housing.

16. The apparatus according to claim 1, wherein the barrier includes a peripheral portion attached to a body portion.

17. The apparatus according to claim 16, wherein the peripheral and body portions are integrally formed.

18. The apparatus according to claim 16, wherein the peripheral and body portions are separately formed.

19. The apparatus according to claim 16, wherein at least one of the peripheral and body portions is made of a flexible material.

20. The apparatus according to claim 16, wherein at least one of the peripheral and body portions is made of a substantially rigid material.

21. The apparatus according to claim 16, wherein one of the peripheral and body portions is made of a flexible material, and the other of the peripheral and body portions is made of a substantially rigid material.

22. The apparatus according to claim 16, further comprising a stiffener attached to the peripheral portion.

23. The apparatus according to claim 22, wherein the stiffener is made of a metallic material.

24. The apparatus according to claim 22, wherein the stiffener is made of a nonmetallic material.

25. The apparatus according to claim 22, wherein the stiffener is bonded to the peripheral portion.

26. The apparatus according to claim 25, wherein the stiffener is adhesively bonded to the peripheral portion.

27. The apparatus according to claim 25, wherein the stiffener is thermally bonded to the peripheral portion.

28. The apparatus according to claim 22, wherein the stiffener is molded within the peripheral portion.

29. The apparatus according to claim 1, wherein the barrier is secured relative to the housing by a fastener.

30. The apparatus according to claim 29, wherein the fastener is a threaded ring.

31. The apparatus according to claim 29, wherein the fastener is a radially extendable ring.

32. The apparatus according to claim 1, wherein the barrier includes a check valve, the check valve permitting flow through the barrier in a first direction, and preventing flow through the barrier in a second direction.

33. The apparatus according to claim 1, wherein the barrier includes a closure member, the closure member selectively preventing and permitting relatively unrestricted flow of the fluid through the barrier.

34. The apparatus according to claim 1, wherein the barrier is axially reciprocably disposed within a bore.

35. The apparatus according to claim 34, wherein the bore is disposed within the housing.

36. The apparatus according to claim 1, further comprising a filtering device positioned relative to the barrier.

37. The apparatus according to claim 36, wherein the filtering device is axially spaced apart from the barrier.

38. The apparatus according to claim 1, wherein the barrier includes a peripheral portion attached to a body portion, the body portion being displaceable relative to the peripheral portion without elongating the body portion.

39. The apparatus according to claim 38, wherein the body portion is made of an elastomeric material.

40. The apparatus according to claim 38, wherein the body portion is made of a nonelastomeric material.

41. The apparatus according to claim 1, wherein the barrier is disposed within a tubular structure, the tubular structure being spaced apart from the housing.

42. Apparatus operatively positionable in a subterranean well, the apparatus comprising:

a housing having a flow passage formed therethrough;

a dispersible plug member preventing flow through the flow passage, the plug member being dispersible upon contact with a fluid;

at least one barrier substantially maintaining a volume of the fluid between the barrier and the plug member.

43. The apparatus according to claim 42, wherein the barrier is made of an expandable material.

44. The apparatus according to claim 42, wherein the barrier cooperatively expands and contracts in response to expansion and contraction of the volume of the fluid.

45. The apparatus according to claim 42, wherein at least a portion of the barrier is substantially porous.

46. The apparatus according to claim 42, wherein the barrier includes at least one opening formed therethrough.

47. The apparatus according to claim 42, wherein the apparatus includes at least two barriers.

48. The apparatus according to claim 47, wherein only one of the barriers has at least one opening formed therethrough.

49. The apparatus according to claim 47, wherein each of the barriers has at least one opening formed therethrough.

50. The apparatus according to claim 49, wherein the openings formed through adjacent ones of the barriers are misaligned.

51. The apparatus according to claim 47, further comprising a filtering device disposed between the barriers.

52. The apparatus according to claim 47, wherein less than all of the barriers each has an opening formed therethrough.

53. The apparatus according to claim 42, wherein only a portion of the barrier is made of a substantially porous material.

54. The apparatus according to claim 42, wherein the barrier is axially spaced apart from the plug member.

55. The apparatus according to claim 42, wherein the barrier is retained within the housing.

56. The apparatus according to claim 42, wherein the barrier includes a peripheral portion attached to a body portion.

57. The apparatus according to claim 56, wherein at least one of the peripheral and body portions is made of a flexible material.

58. The apparatus according to claim 56, wherein at least one of the peripheral and body portions is made of a substantially rigid material.

59. The apparatus according to claim 56, wherein one of the peripheral and body portions is made of a flexible material, and the other of the peripheral and body portions is made of a substantially rigid material.

60. The apparatus according to claim 56, further comprising a stiffener attached to the peripheral portion.

61. The apparatus according to claim 60, wherein the stiffener is bonded to the peripheral portion.

62. The apparatus according to claim 42, wherein the barrier is secured relative to the housing by a fastener.

63. The apparatus according to claim 42, wherein the barrier includes a check valve, the check valve permitting flow through the barrier in a first direction, and preventing flow through the barrier in a second direction.

64. The apparatus according to claim 42, wherein the barrier includes a closure member, the closure member selectively preventing and permitting relatively unrestricted flow of the fluid through the barrier.

65. The apparatus according to claim 42, wherein the barrier is axially reciprocably disposed within a bore.

66. The apparatus according to claim 65, wherein the bore is disposed within the housing.

67. The apparatus according to claim 42, further comprising a filtering device positioned relative to the barrier.

68. The apparatus according to claim 42, wherein the barrier includes a peripheral portion attached to a body portion, the body portion being displaceable relative to the peripheral portion without elongating the body portion.

69. The apparatus according to claim 42, wherein the barrier is disposed within a tubular structure, the tubular structure being separately attached to the housing.

70. The apparatus according to claim 42, wherein the barrier extends across the flow passage.

71. Apparatus operatively positionable in a subterranean well, the apparatus comprising:

a tubular member having an axial passage formed therethrough;

at least one barrier extending across the passage; and a dispersible plug structure extending across the passage in an axially spaced relationship with the barrier and preventing flow through the axial passage, the barrier and the dispersible plug structure forming opposite ends of a longitudinal portion of the axial passage extending therebetween and adapted to hold a quantity of fluid useable to disperse the plug structure and isolated between the barrier and the dispersible plug structure.

72. The apparatus according to claim 71, wherein the barrier is made of an expandable material.

73. The apparatus according to claim 71, wherein the barrier is porous.

74. The apparatus according to claim 71, wherein the barrier includes at least one opening formed therethrough.

75. The apparatus according to claim 71, wherein the apparatus includes at least two barriers.

76. The apparatus according to claim 75, wherein only one of the barriers has at least one opening formed therethrough.

77. The apparatus according to claim 75, wherein each of the barriers has at least one opening formed therethrough.

78. The apparatus according to claim 77, wherein the openings formed through adjacent ones of the barriers are aligned.

79. The apparatus according to claim 77, wherein the openings formed through adjacent ones of the barriers are misaligned.

80. The apparatus according to claim 75, further comprising a filtering device disposed between the barriers.

81. The apparatus according to claim 75, wherein less than all of the barriers have an opening formed therethrough.

82. The apparatus according to claim 71, wherein only a portion of the barrier is made of a porous material.

83. The apparatus according to claim 71, wherein a peripheral edge of the barrier is retained within an annular recess formed within the tubular member.

84. The apparatus according to claim 71, wherein the barrier includes a peripheral portion attached to a body portion.

85. The apparatus according to claim 84, wherein the peripheral and body portions are integrally formed.

86. The apparatus according to claim 84, wherein the peripheral and body portions are separately formed.

87. The apparatus according to claim 84, wherein at least one of the peripheral and body portions is made of a flexible material.

88. The apparatus according to claim 84, wherein at least one of the peripheral and body portions is made of a substantially rigid material.

89. The apparatus according to claim 84, wherein one of the peripheral and body portions is made of a flexible material, and the other of the peripheral and body portions is made of a substantially rigid material.

90. The apparatus according to claim 84, further comprising a stiffener attached to the peripheral portion.

91. The apparatus according to claim 90, wherein the stiffener is made of a metallic material.

92. The apparatus according to claim 90, wherein the stiffener is made of a nonmetallic material.

93. The apparatus according to claim 90, wherein the stiffener is bonded to the peripheral portion.

94. The apparatus according to claim 93, wherein the stiffener is adhesively bonded to the peripheral portion.

95. The apparatus according to claim 93, wherein the stiffener is thermally bonded to the peripheral portion.

96. The apparatus according to claim 90, wherein the stiffener is molded within the peripheral portion.

97. The apparatus according to claim 71, wherein the barrier is secured relative to the tubular member by a fastener.

98. The apparatus according to claim 97, wherein the fastener is a threaded ring.

99. The apparatus according to claim 97, wherein the fastener is a radially extendable ring.

100. The apparatus according to claim 71, wherein the barrier includes a check valve, the check valve permitting flow through the barrier in a first direction, and preventing flow through the barrier in a second direction.

101. The apparatus according to claim 71, wherein the barrier includes a closure member, the closure member selectively preventing and permitting relatively unrestricted flow of fluid through the barrier.

102. The apparatus according to claim 71, wherein the barrier is axially reciprocably disposed within a bore.

103. The apparatus according to claim 102, wherein the bore is disposed within the tubular member.

104. The apparatus according to claim 71, further comprising a filtering device positioned relative to the barrier.

105. The apparatus according to claim 104, wherein the filtering device is axially spaced apart from the barrier.

106. The apparatus according to claim 71, wherein the barrier includes a peripheral portion attached to a body portion, the body portion being displaceable relative to the peripheral portion without elongating the body portion.

107. The apparatus according to claim 106, wherein the body portion is made of an elastomeric material.

108. The apparatus according to claim 106, wherein the body portion is made of a nonelastomeric material.

* * * * *